US005318335A

United States Patent [19]

Ehrlich

[11] Patent Number: 5,318,335

[45] Date of Patent: Jun. 7, 1994

[54] CONTAINER LIFTING DEVICE

[75] Inventor: Rodney P. Ehrlich, Monticello, Ind.

[73] Assignee: Wabash National Corporation, Lafayette, Ind.

[21] Appl. No.: 981,509

[22] Filed: Nov. 25, 1992

[51] Int. Cl.[5] ..... B65D 90/00

[52] U.S. Cl. ..... 294/68.1; 294/68.3; 220/1.5

[58] Field of Search ..... 294/68.1, 68.3, 81.51, 294/81.54; 220/1.5

[56] References Cited

U.S. PATENT DOCUMENTS

| | | | |
|---|---|---|---|
| 1,485,972 | 3/1924 | Fitch | 294/68.3 |
| 1,926,432 | 9/1933 | Butts et al. | 220/1.5 X |
| 2,056,178 | 10/1936 | Fitch | 220/1.5 |
| 3,189,376 | 6/1965 | Johansson | 294/68.1 |
| 3,406,855 | 10/1968 | McKechnie | 220/1.5 |
| 4,810,027 | 3/1989 | Ehrlich | 296/181 |
| 4,944,421 | 7/1990 | Yurgevich | 220/1.5 |
| 5,072,845 | 12/1991 | Grogan | 220/1.5 |

*Primary Examiner*—Dean J. Kramer

*Attorney, Agent, or Firm*—Trexler, Bushnell, Giangiorgi & Blackstone, Ltd.

[57] ABSTRACT

Freight container construction having opposing body side panels, adapted for lifting by an overhead crane includes lifting support structures which are exteriorly secured to and transfer the lifting load to the panels. Couplers formed on the lifting support structures are disposed exteriorly adjacent to the panels which bear the lifting load.

7 Claims, 3 Drawing Sheets

CONTAINER LIFTING DEVICE

BACKGROUND OF THE INVENTION

The present invention relates generally to overhead lifting of freight trailer containers, and more particularly relates to the structure of lifting supports provided on the container body assemblies.

Roadway trailer containers and other containerized freight which are loaded onto railroad or even ship transport using overhead lifting cranes have required the construction of the container body itself to withstand the overhead lifting load. When the crane is coupled to couplers on the top of the container, the coupler structures have required the container construction to provide extensive framework to distribute the load from the four coupled "top pick points" provided on the roof of the container. Conventionally, the top pick points or lifting coupler structures have required projection and reinforcement within the body of the container which reduces the available freight volume. The present invention eliminates the foregoing disadvantages.

SUMMARY OF THE INVENTION

In accordance with the present invention, freight container construction having opposing body side panels, adapted for lifting by an overhead crane includes lifting support structures which are exteriorly secured to and transfer the lifting load to the panels. Couplers formed on the lifting support structures are disposed exteriorly adjacent to the panels which bear the lifting load.

In one embodiment, the lifting support structures have a corner-shaped configuration mounted over a top rail of a plate-type container side panel so that a first leg of the corner configuration is secured to the vertical plate and a second leg of the corner configuration is secured upon the roof. Bracing headers which bridge opposing plates in the opposite body side panels provide roof bows which also function to reinforce the upper horizontal leg of the lifting support corner configuration. A hook-like structure can be cast with the corner configuration to form the coupler of the lifting support.

DESCRIPTION OF THE ILLUSTRATED EMBODIMENT

Figure 1:
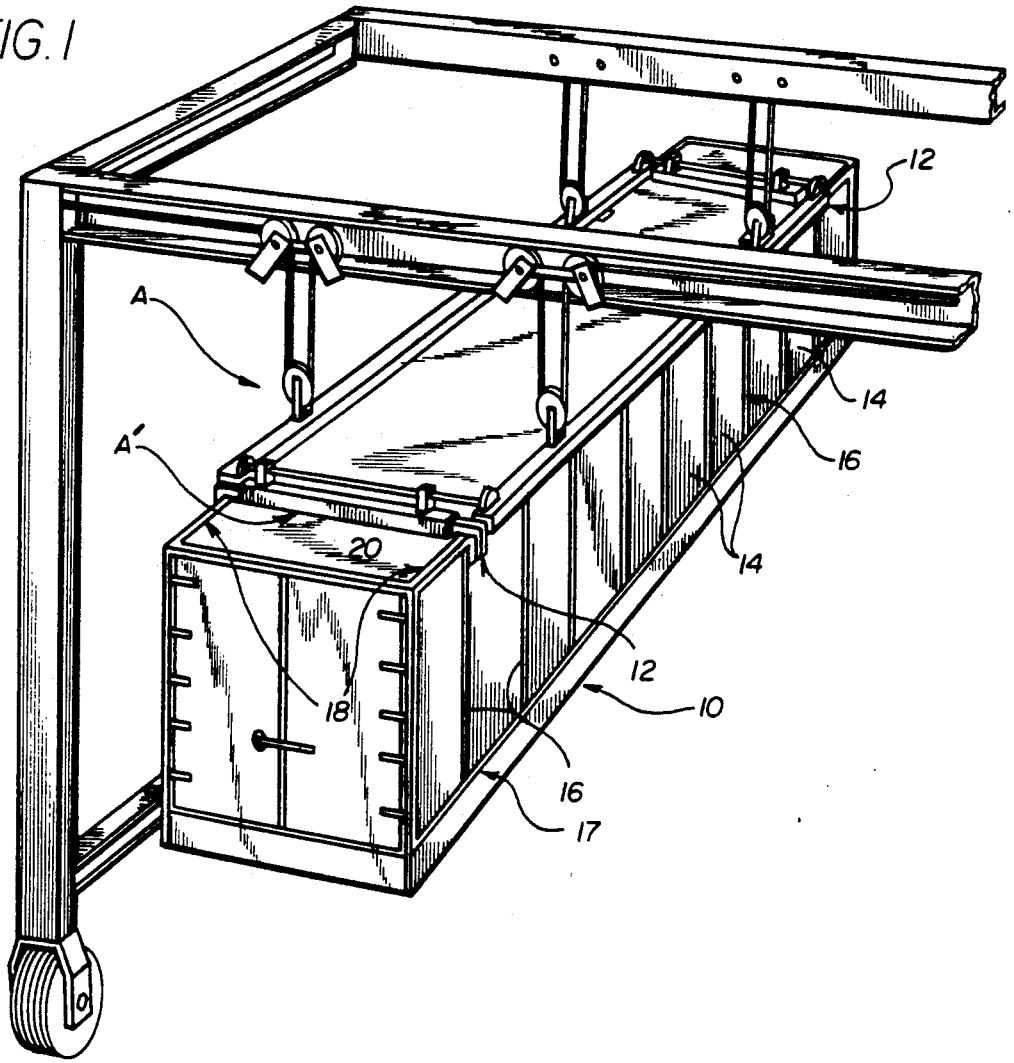
FIG. 1 is a perspective view of one embodiment of a container and lifting structure in accordance with the invention, coupled for overhead lifting by a crane.
Figure 2:
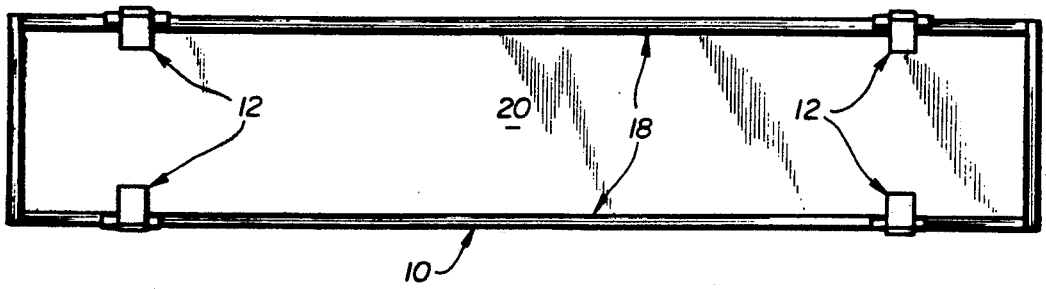
FIG. 2 is a top plan view of the container shown in FIG. 1.

Referring to FIG. 1, one embodiment of a freight container structure in accordance with the present invention is generally designated by reference character 10 and shown being lifted by a typical overhead crane structure A. The crane A can have a lifting frame structure A′ which is coupled to four lifting supports 12 or "top picks" on the top of the container 10 as best shown in FIG. 2.

In the illustrated embodiment, the sides of the body of the container 10 are assembled from multiple pairs of vertical plates 14 supported by vertical posts 16, for example as described in U.S. Pat. No. 4,810,027 which is incorporated by a reference for discussion of particularly preferred side panel construction. A top rail 18 extends the entire length of the assembled plates 14 and posts 16 for supporting the plates 14 and securing the roof 20. A floor assembly (not shown) is secured to the lower frame 17. As shown in FIGS. 1 and 2, the lifting supports 12 are paired in alignment across the roof 20 and secured at the shoulders formed by the respective rails 18. Each of the supports 12 is located between consecutive posts 16. The two supports 12 can be spaced for example approximately 40 feet on a side of the body having a length for example of 53 feet, in order to provide four-point lifting stability using an overhead crane.

Figure 3:
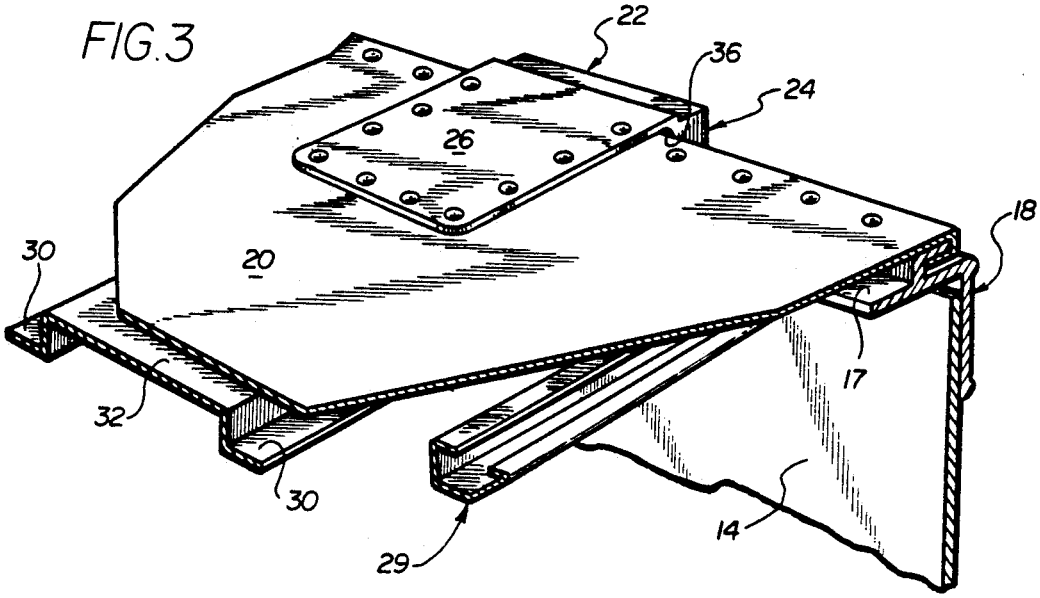
FIG. 3 is a perspective, fragmentary view broken away from the container shown in FIGS. 1 and 2 for illustration of the container construction cooperating with the lifting structures.
Figure 6:
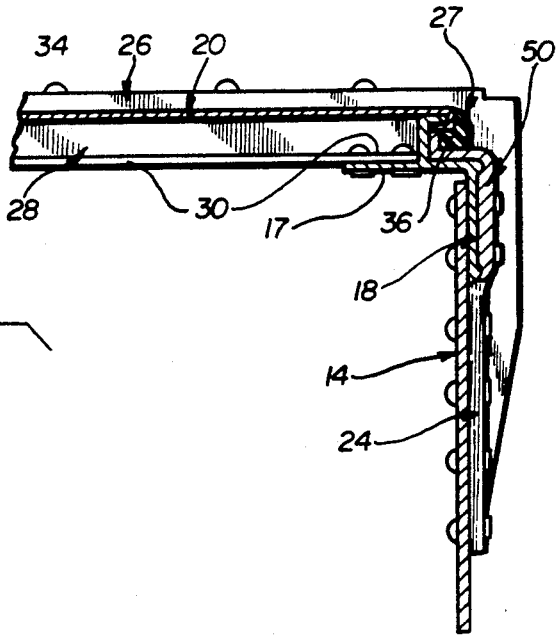
FIG. 6 is a sectional view along a plane indicated by line 6—6 in FIG. 4.

Referring now to FIGS. 3–8, each of the lifting supports 12 includes a corner shaped casting 22 including a first leg 24 which is riveted to the exterior surface of the plate 14 and the second leg 26 which is riveted through the roof 20 into a reinforcing brace member 28 which transversely supports opposing plates 14 forming the opposite side panels of the container body 10. As best shown in FIGS. 3 and 6, in the illustrated embodiment, the brace or header 28 includes spaced mounting webs 30 which are riveted to the inwardly projecting flange portion 17 of the top rail 18. The elevated, central panel 32 of the brace 28 supports the roof and secures the riveted second leg 26 of each of the opposing castings 22 of the supports 12. Preferably, the brace members 28 are fabricated from ⅛-inch steel in order to support the dead load of the crane frame A′ prior to coupling, (in comparison to the conventional aluminum roof bows 29 provided in the container 10).

Figure 4:
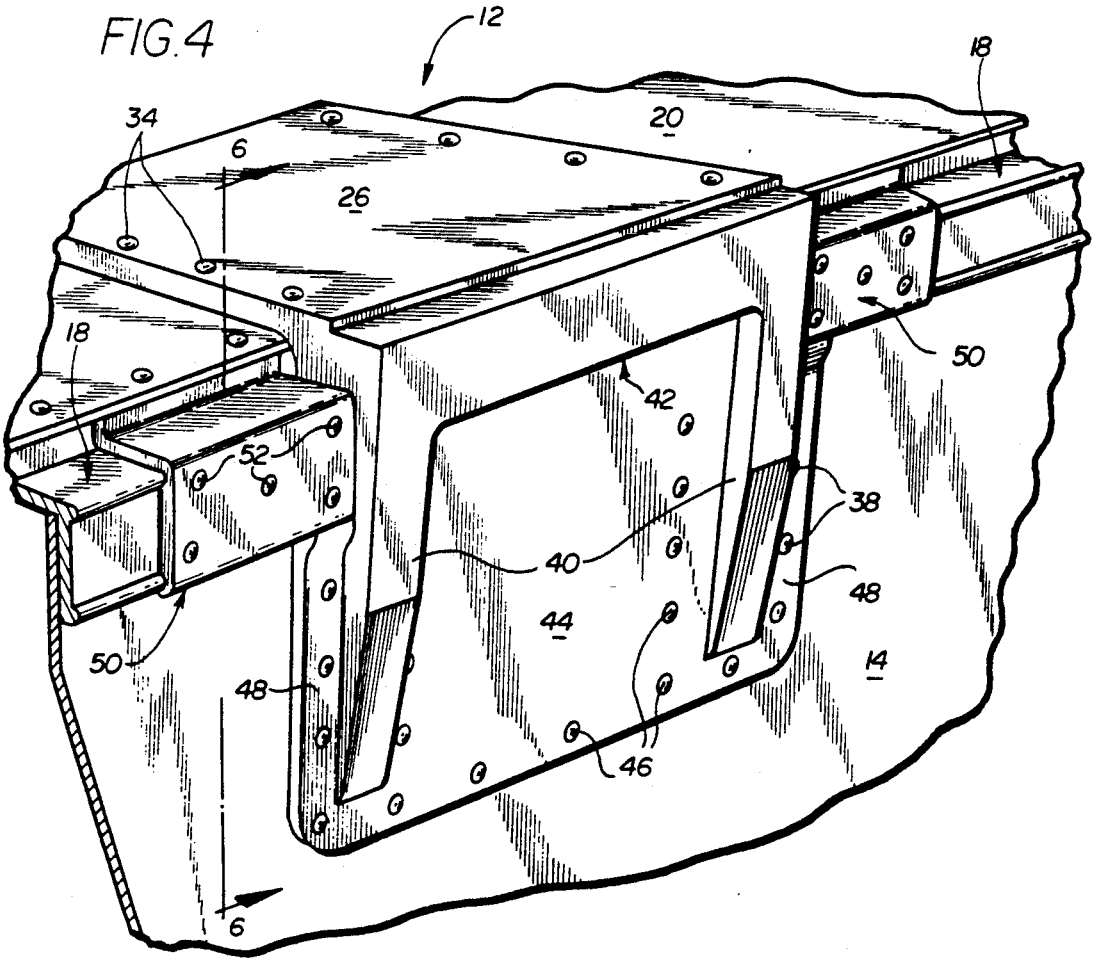
FIG. 4 is an enlarged perspective side view of the container and lifting structure shown in FIGS. 1–3.
Figure 5:
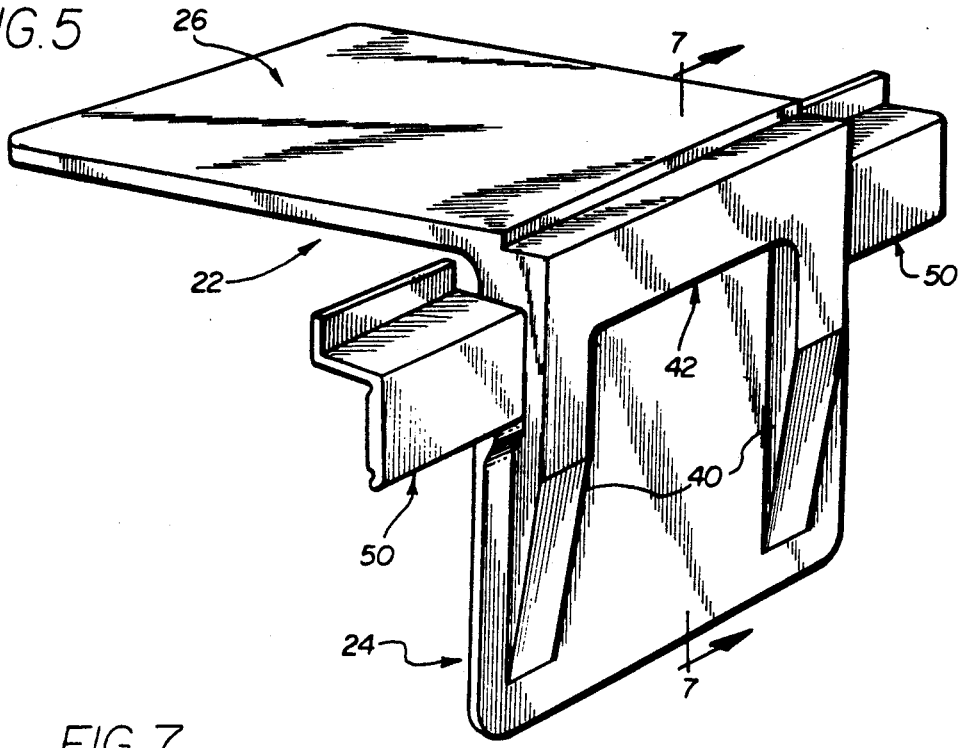
FIG. 5 is a perspective view of the corner casting portion of the lifting structure shown in FIGS. 1–4.
Figure 7:
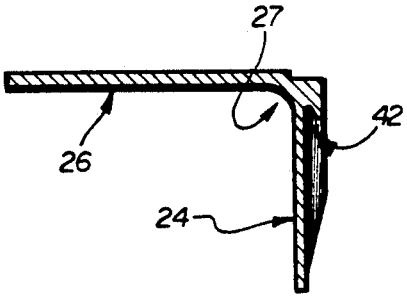
FIG. 7 is a sectional view along a plane indicated by line 7—7 in FIG. 5.

The curved elbow portion 27 of the casting 22 compresses a rubber weather seal 36 against the top rail 18 as best shown in FIG. 4. The first, vertical leg 24 of the casting 22 is riveted at 38 into the supporting vertical plate 14 which is preferably at least 0.16-inch thick aluminum so that the plate 14 bears the tensile load of the overhead lifting by the crane. The lifting structures 12 thus benefit from the structural integrity of the 0.16-inch aluminum plate for support without requiring additional frame reinforcement. Alternatively, container wall construction employing integral sheet panels of sufficient gauge can also bear the tensile load transferred by the similarly secured lifting structures 12.

Figure 8:
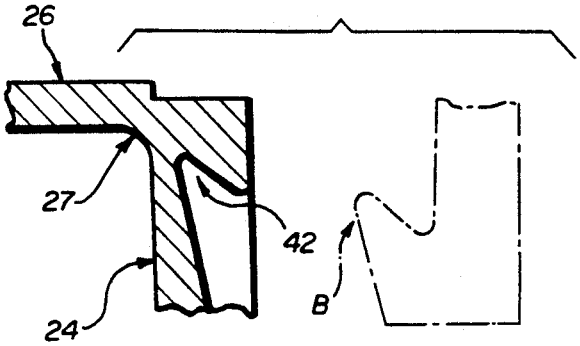
FIG. 8 is an enlarged, fragmentary sectional view of a coupling hook portion of a lifting support shown in FIG. 7.

Outwardly projecting from the leg 24 is an integral, generally three-sided boss portion of the casting 22 which includes two spaced, vertically extending arms 40 which generally taper downwardly from an upper span 42 having a hooked cross sectional configuration as best shown in FIG. 8. Referring again to FIG. 4, the arms 40 and the medial leg surface 44 therebetween serve to guide a complementary hook member B (FIG.

8) of the crane A into mating engagement with the upper span casting hook 42 in the coupling action preparatory to overhead lifting operations. Accordingly, the rivet heads 46 are flush with the medial surface 44, whereas the rivets 38 through the lateral flange portions 48 as well as the rivets 34 into the roof 20 and brace 32 can have heads of truss or other configuration for greater purchase. For additional lateral reinforcement, a pair of reinforcing caps 50 are welded to and straddle the vertical casting leg 24 and are rivetted at 52 into the top rail 18.

The elongate hook configuration 42 projecting slightly outwardly from the vertical casting leg 24 enables the lifting supports 12 to suppress any twisting movement from the overhead lifting operation, as well as to have a low-height clearance and sturdy lateral profile, although alternative coupling configuration can be provided in coordination with other crane couplers.

While particular embodiments of the present invention have been described herein, it will be obvious to those skilled in the art that changes and modifications in various aspects may be made without departing from the broad scope of the invention. Consequently, the scope of the invention is not limited by any particular embodiment but is defined by the appended claims and the equivalents thereof. In the claims, the term "container structure" is intended to refer to all types of containers including those adapted to be detachably mounted on a separate trailer chassis and those which are incorporated into a trailer structure.

The invention is claimed as follows:

1. A freight container structure adapted for lifting by an overhead crane, comprising:

a pair of opposing side panels defining containing walls of the container structure, each panel including an assembly of adjacent vertical plates joined by supporting vertical posts and a top rail secured to upper ends of said adjacent plates and joining said plates to a roof thereon; and a lifting support structure secured to at least one of said plates between adjacent posts and transferring lifting load thereto, said lifting support structure having coupling means for coupling to the crane and lifting the container structure wherein said coupling means comprises a hook structure projecting from said lifting support structure.

2. A container structure according to claim 1 wherein said hook structure comprises a downwardly projecting angular configuration extended transversely across said first leg.

3. A container structure according to claim 1 further comprising at least one brace member bridging said opposing side panels, said lifting support structure being further secured to said brace member.

4. A container structure according to claim 3 wherein said brace member underlies said roof through which said brace member and lifting support structure are joined.

5. A container structure according to claim 3 wherein a pair of said lifting support structures are oppositely aligned adjacent respective ends of said brace member.

6. A container structure according to claim 3 wherein said lifting support structure comprises a corner configuration having a first leg secured to said plate and a second leg joined to said brace member.

7. A freight container structure adapted for lifting by an overhead crane, comprising a pair of opposing side panels defining containing walls of the container structure, each panel including an assembly of adjacent vertical plates joined by supporting vertical posts; a top rail secured to upper ends of said adjacent plates and joining said plates to a roof thereon; a floor assembly secured to a lower frame assembly joining lower ends of said plates; at least one reinforcing brace member bridging said opposing side panels; and a lifting support structure having a corner configuration including a first, vertical leg member secured to at least one of the said plates between adjacent posts and a second, horizontal leg member secured through said roof to said brace member and coupling means for coupling said lifting support structure to said crane in order to lift the container structure.

* * * * *